US007448934B2

(12) United States Patent
Van Dan Elzen et al.

(10) Patent No.: US 7,448,934 B2
(45) Date of Patent: Nov. 11, 2008

(54) MOTOR YO-YO

(76) Inventors: Hans W. Van Dan Elzen, 4750 S. Stallion Dr., Gilbert, AZ (US) 85297; Thomas J. Van Dan Elzen, 1217 W. Central Ave., Coolidge, AZ (US) 85228

( * ) Notice: Subject to any disclaimer, the term of this patent is extended or adjusted under 35 U.S.C. 154(b) by 224 days.

(21) Appl. No.: 11/268,219

(22) Filed: Nov. 7, 2005

(65) Prior Publication Data

US 2007/0105478 A1 May 10, 2007

(51) Int. Cl.
*A63H 1/30* (2006.01)

(52) U.S. Cl. ..... 446/250; 446/236

(58) Field of Classification Search ..... 446/247–264
See application file for complete search history.

(56) References Cited

U.S. PATENT DOCUMENTS

| | | | | |
|---|---|---|---|---|
| 3,899,849 | A * | 8/1975 | Witiak | 446/137 |
| 3,935,667 | A | 2/1976 | Vitt | |
| 5,135,425 | A * | 8/1992 | Andrews et al. | 446/133 |
| 5,506,459 | A * | 4/1996 | Ritts | 446/256 |
| 5,947,790 | A | 9/1999 | Gordon | |
| 6,309,274 | B1 * | 10/2001 | Thomson et al. | 446/165 |
| 6,579,142 | B1 * | 6/2003 | Rehkemper et al. | 446/247 |
| 6,634,922 | B1 * | 10/2003 | Driscoll et al. | 446/242 |
| 6,770,012 | B2 * | 8/2004 | Kuo | 446/248 |
| 7,037,169 | B2 * | 5/2006 | Benedek et al. | 446/242 |
| 2004/0198151 | A1 * | 10/2004 | Bell | 446/247 |
| 2005/0048869 | A1 | 3/2005 | Osawa et al. | |
| 2005/0280322 | A1 * | 12/2005 | Tsou | 310/67 R |
| 2006/0166745 | A1 * | 7/2006 | Lo | 463/46 |

FOREIGN PATENT DOCUMENTS

JP 2003126560 5/2003

* cited by examiner

*Primary Examiner*—Gene Kim
*Assistant Examiner*—Urszula M Cegielnik
(74) *Attorney, Agent, or Firm*—Franklin L. Gubernick

(57) ABSTRACT

The invention is a yo-yo in which at least one of the yo-yo's sides includes a powered rotation system capable of maintaining the yo-yo's rotation when the yo-yo is sleeping at the end of its tether. The system functions by converting one of the yo-yo's sides into a motor, and includes a number of permanent magnets, an electromagnet, a sensor capable of detecting a magnet field, and a power source.

23 Claims, 7 Drawing Sheets

MOTOR YO-YO

FIELD OF THE INVENTION

The invention is in the field of user-manipulated toys. More particularly, the invention is a yo-yo that has at least one side portion that incorporates components that create a powered rotation system. The rotation system essentially converts the side portion into a motor and comprises a plurality of permanent magnets, a sensor capable of detecting a magnetic field, an electromagnet and a power source. The sensor, electromagnet and power source are preferably secured to an independently rotatable circuit board that is located within a cavity in the side portion. Through the operation of the rotation system, the yo-yo can maintain its rotation for a prolonged period of time when it is sleeping at the end of its tether.

BACKGROUND OF THE INVENTION

Most yo-yos typically comprise two disk-shaped side portions that are rigidly connected to each other by some form of axle structure. The side portions are usually of unitary construction and may be made out of plastic, metal or wood. The axle structure is normally secured to the center of both side portions and can be an assembly having multiple parts, or merely be in the form of a dowel or a riveted pin. In many modern yo-yos, a ball bearing unit, or other rotatable member, is secured to, and has at least a portion rotatable on, a center portion of the axle structure.

The axle structure also forms an anchor for one end of a string-type tether. An end-located loop portion of the tether is positioned so that it encircles a center portion of the axle structure. The free end of the tether is usually tied to create a second loop portion that can be placed about one of a user's fingers to thereby temporarily secure the yo-yo to the user's hand.

When one end of the tether is secured to a user's finger and the remainder of the tether is wound about the axle structure, the yo-yo is ready for use. When the yo-yo is released, or thrown, from the user's hand, the yo-yo will begin to rapidly spin as the tether unwinds from about the axle structure and the yo-yo moves away from the user's hand. Once the tether is fully unwound, the yo-yo may "sleep" at the end of the tether, whereby the yo-yo's side portions continue to spin without the tether rewinding on the axle structure. This is enabled by either having the tether's end loop slip on the axle structure, or by having the tether's end loop secured to a freely rotatable member that is secured to, or forms a portion of, the axle structure. Once the yo-yo is sleeping, there are a number of tricks, such as "walk the dog," that a person can perform with the spinning yo-yo. A sleeping yo-yo is also often used to perform tricks that involve temporarily placing the spinning yo-yo onto a portion of the tether intermediate of the tether's two ends.

When a typical yo-yo is sleeping at the end of the tether and the user wishes to cause the yo-yo to return to his or her hand, the user will make a quick tug/jerk on the yo-yo's tether. This results in a brief tightening of the tether, and is automatically followed by a temporary slackening of the tether. Once the tether goes slack, the tether's twist causes one, or more, portions of the tether located proximate the axle structure to move outwardly and contact a spinning portion of the yo-yo. Once contact has occurred, the tether portion(s) can become snagged on, or otherwise engaged to, the spinning portion of the yo-yo. Continued rotation of the spinning portion of the yo-yo will then cause the tether to wind about the axle structure, resulting in the yo-yo's return to the user's hand.

An extremely important performance characteristic of a yo-yo is its potential sleep time. Since most yo-yo tricks are performed while the yo-yo is sleeping, the longer a yo-yo can be made to sleep, the more time a user will have to complete any particular yo-yo trick. While some tricks can be performed quickly, others require a yo-yo that is capable of sleeping for a relatively long period of time.

To enable the performance of a large variety of tricks, every yo-yo player wants a yo-yo that is capable of sleeping for a long time. However, a long sleep time is extremely difficult to achieve using a basic yo-yo in which the tether slides on the axle structure. The sliding action can create a significant amount of friction that causes the yo-yo to rapidly lose its rotational momentum.

Many modern yo-yos employ a ball bearing that essentially eliminates friction between the tether and the axle structure. However, since friction is not entirely eliminated in ball bearing yo-yos, and yo-yos still experience significant drag due to air resistance, most ball bearing yo-yos will not sleep for longer than about thirty seconds. To achieve even that long a spin time, the user may be required to expend a great deal of effort manipulating the tether to prevent the tether from contacting a spinning portion of the yo-yo. Should the tether contact a spinning portion of the yo-yo, significant friction will be created that can greatly decrease the yo-yo's sleep time.

There is therefore a need in the art for a yo-yo that will readily sleep, and once sleeping, will continue to sleep for an extremely long period of time. In addition, it is desirable to provide a yo-yo that can sleep for an extended period of time that does not require a user to expend significant effort in preventing the tether from contacting a spinning portion of the yo-yo.

SUMMARY OF THE INVENTION

The invention is a yo-yo that includes at least one electrically-powered rotation system that functions to maintain the yo-yo's rotation/rotational momentum once the yo-yo is sleeping. In the preferred embodiment, each of the yo-yo's side portions has its own electrically-powered rotation system.

An electrically-powered rotation system in accordance with the invention essentially converts a side portion of a yo-yo into a motor. To accomplish this, the system includes a plurality of permanent magnets that are spaced apart from each other and are fixedly secured to the side portion, preferably proximate it's rim. The system further includes an elongated circuit board that is rotatably secured to the side portion and features a sensor on one end and an electromagnet on the other. The sensor is capable of detecting a magnetic field, and the electromagnet is capable of applying force to any of the permanent magnets in its vicinity. The circuit board preferably additionally includes at least one replaceable battery and a relay. The circuit board may optionally include an on-off switch that can be employed by a user to turn on, or off, the system. The rotatable mounting of the circuit board enables relative rotation between the circuit board and the side portion's rim when the yo-yo is sleeping.

In operation, every time one of the permanent magnets passes the sensor, the electromagnet is caused to be temporarily energized whereby said electromagnet will apply a force to at least one of the other permanent magnets. The weight of the electromagnet provides a mass that the force, either a push or pull, works against to either attract, or repel, the permanent magnet(s) located near the electromagnet. In this manner, the electromagnet acts to maintain the rotational momentum of the side portion. This effect will continue until the power source for the rotation system is depleted. It should be noted that the rotation system will maintain the rotation of the yo-yo no matter which direction, clockwise or counter-clockwise, the yo-yo is rotating. This results from the triggering of the electromagnet being accomplished via a circuit that employs a sensor, in combination with the magnets being located in a predetermined relation to each other and with their magnetic poles being oriented in a predetermined manner.

The yo-yo's powered rotation system enables the yo-yo to sleep for a greatly extended period of time. This enables a user to perform one or more yo-yo tricks with the yo-yo without having to worry about the yo-yo slowing down to a point where it will no longer return to his or her hand. The yo-yo's extremely long sleep time also enables a user to perform complicated yo-yo tricks, or a series of yo-yo tricks, or repeatedly practice the same yo-yo trick, using only a single throw of the yo-yo.

The invention is therefore a unique yo-yo that has the ability to sleep for an extended period of time under its own power. This enables the yo-yo to be used by any player to easily perform yo-yo tricks without having to worry about the yo-yo slowing down to an extent where it will not return to the user's hand upon the completion of the yo-yo trick(s).

DETAILED DESCRIPTION OF THE DRAWINGS

Figure 1:
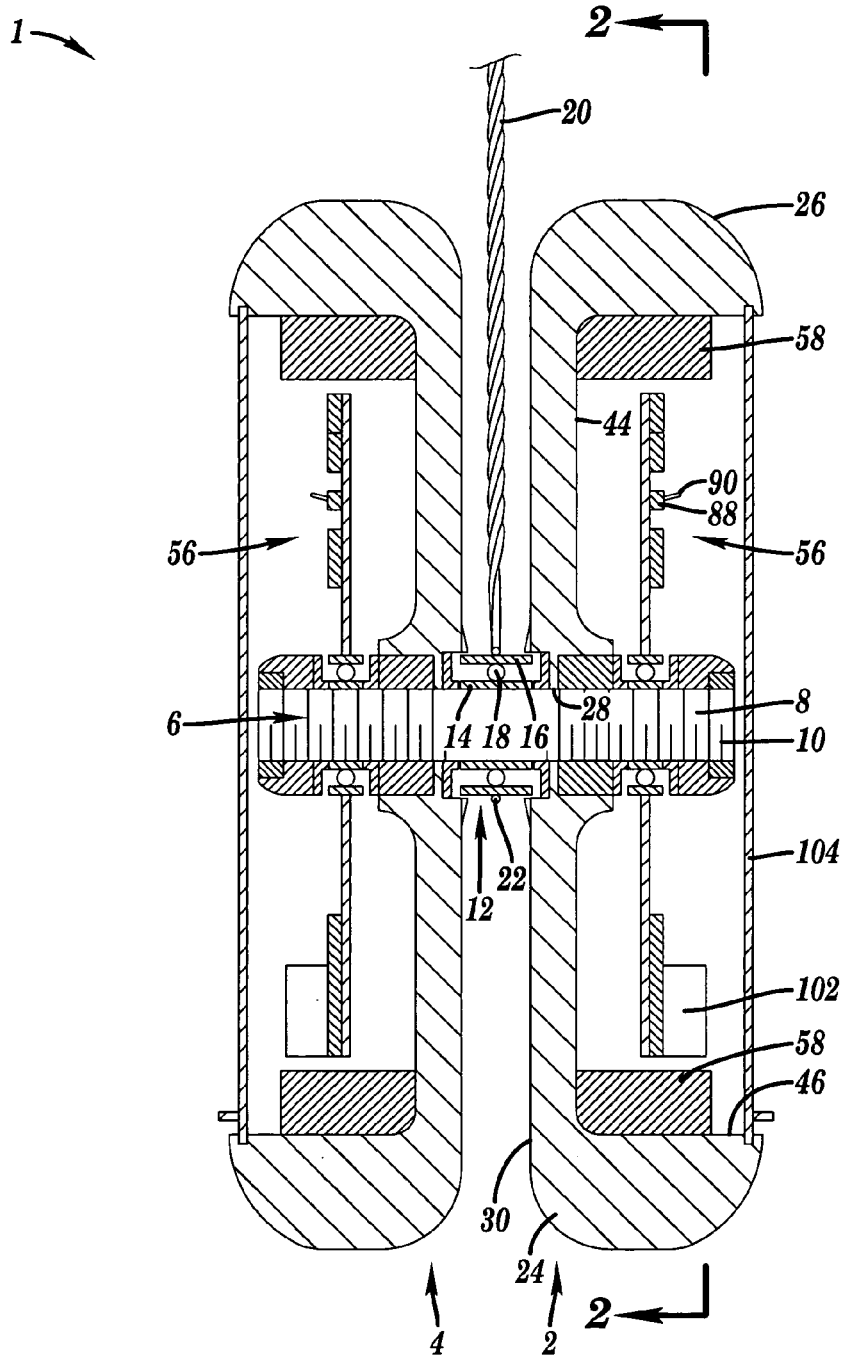
FIG. 1 is a front, cross-sectional view of a first embodiment of a yo-yo in accordance with the invention.

Looking now to the drawings in greater detail, wherein like reference numerals refer to like parts throughout the several figures, there is indicated by the numeral 1 a yo-yo in accordance with the invention.

The yo-yo 1 includes a first side portion 2 and a second side portion 4. The two side portions are connected together via an axle structure 6. The axle structure is preferably an assemblage of parts and comprises an axle pin 8 that has exterior threads 10 located at each end and a longitudinal axis that is co-linear with the yo-yo's axis of rotation. Rotatably located on a center portion of the axle structure is a conventional ball bearing unit 12 that has an inner race 14 and an outer race 16. The ball bearing unit includes a plurality of interior ball bearings 18 that enable the outer race to be rotatable relative to the inner race. A string-type tether 20 includes a loop portion 22 that encircles the ball bearing unit's outer race 16. The tether's distal end (not shown) will normally be tied to create a loop to enable a temporary securement of said end to one of a user's fingers.

Side portion 2 is an assemblage of parts and includes a disk-shaped body member 24. Said body member is preferably made of a rigid, or substantially rigid, plastic material. Alternatively, the body member can be made of other materials, including metal, wood, rubber or be a composite or assemblage of rigid and/or non-rigid parts.

The body member 24 has a rim portion 26, a center-located thru-bore 28 and an inwardly-facing surface 30. Surface 30 may also be referred to as a tether-facing surface since it faces said tether when said tether is taut and is extending outwardly from the axle structure in a direction perpendicular to the yo-yo's axis of rotation. It should be noted that the ball bearing unit 12 is partially received within a circular cavity 32 located in the center of the body member's surface 30. Located between the ball bearing unit and the body member is a washer 34 that has a center-located, annular step portion 36 that extends toward, and contacts, the inner race of the ball bearing unit. In this manner, the ball bearing unit's outer race 16 does not contact the washer or the body member and is therefore freely rotatable.

Located on surface 30 outwardly of cavity 32 are a plurality of optional tether-engagement members 40 that are oriented in a radially-directed manner and form a starburst-shaped array. Each tether engagement member protrudes from surface 30 in a direction toward said tether. The tether engagement members function to facilitate an engagement between the yo-yo's tether and the body member when a user manipulates the tether in a manner that causes the yo-yo to return to his or her hand. Other known types of surface adaptations that facilitate tether engagement in yo-yos, such as indentations, spaced pads/protrusions, or the use of a material, such as rubber, that has a high coefficient of friction, may also be simultaneously or alternatively employed on, or in, surface 30. Surface 30 may also alternatively be featureless and/or be tapered.

The body member also has a large, outwardly-facing cavity 42. The cavity has a bottom surface 44 and a circular sidewall 46. An outwardly-extending nipple portion 48 of the body member is located at the center of the cavity. It should be noted that the body member's thru-bore 28 extends through the center of portion 48.

The distal end of the nipple portion 48 includes a hexagonally-shaped cavity 50. Non-rotatably secured in said cavity is a hex nut 52 that forms a portion of the axle structure and has a threaded thru-bore 54. The thru-bore's threads are complementary to the threads 10 that are located at each end of the axle pin. Attachment of the hex nut to a threaded end of the axle pin provides the means for securing side portion 2 to the axle pin.

Side portion 2 also includes an electrically-powered rotation system 56. The system comprises a plurality of permanent magnets 58 and a rotatable board member 60 that has a plurality of attached components that interact with the magnets 58.

In the preferred embodiment, there are five magnets 58. The magnets are located within cavity 42 proximate the cavity's sidewall 46 and effectively, proximate the body member's rim portion 26. In the drawings, the permanent magnets are designated 58*a*, 58*b*, 58*c*, 58*d*, and 56*e*. All of said magnets are preferably identical to each other, with the added alphanumeric portion of their designations providing a means to differentiate one from another in the drawing figures.

Each magnet 58 is preferably non-movably secured to the rear surface 44 of cavity 42 through the use of an adhesive or fasteners. While not shown, surface 44 may also, or instead, feature pockets/recesses that inwardly receive each of said magnets, preferably with a slight interference fit.

The magnets 58 may be any form of permanent magnet, but are preferably of the rare earth type. A permanent magnet is herein defined as any member that can act like a magnet without requiring the use of an electrical coil. Preferably, the magnets are evenly spaced apart from each other and each is preferably oriented whereby its South pole is located nearer to the yo-yo's axis of rotation than is the magnet's North pole. While five magnets are shown, there can alternatively be a greater or fewer number of magnets, with an odd number of magnets being preferred.

It should be noted that the axle pin 8 extends outwardly past the distal end 62 of the body member's nipple portion. Located on the axle pin outwardly of the hex nut 52 is another washer 34 that has its annular step portion 36 facing outwardly, away from the body member. Located adjacent the washer is a rotatable unit that is preferably in the form of a second bearing unit 12 through which the axle pin extends. The unit's outer race is secured to a center portion of the board member 60 via the use of adhesives or a clamp (not shown). In lieu of a bearing unit 12, the rotatable unit may alternatively be any type of assembly or member that enables relative rotation, examples of which include various types of bushings and bearings. Located outwardly of said second bearing unit 12 is another washer 34 that has its annular step portion 36 facing toward the bearing unit. The annular step portions of the washers sandwiching the second bearing unit contact the unit's inner race, leaving the unit's outer race, and therefore the board member 60, freely rotatable. In this manner, the board member is freely rotatable relative to the body member.

Located on the end of the axle pin is a cap nut 64. The cap nut has a center bore 66 having threads complementary to threads 10 of the axle pin. Once the cap nut is threadedly secured to the axle pin, it functions to secure the board member to the axle pin.

The board member 60 preferably has an elongated shape and has first and second ends, 70 and 72 respectively. The board member is preferably in the form of a circuit board and is formed from a rigid non-conductive layer 74 upon which is located a pattern of conductive strips 76. Wires may be used in addition to, or in place of, some or all of the strips 76. It should be noted that the board member may have a different shape, such as round or triangular, than is shown in the figures.

Located proximate end 70 of the board member, and secured to the board member, is a sensor 80 that is capable of detecting a magnetic field. The sensor is preferably a Hall-effect sensor of a uni-polar type and switches "on" when it is exposed to a magnetic flux density that is greater than a predetermined amount. In the preferred embodiment, the sensor reacts to magnetic flux from a South pole of a magnet. It should be noted that the sensor 80 can be of any type that can sense a nearby magnetic field. For example, the sensor 80 can be a Reed relay whereby the Reed relay's contacts come together when exposed to a magnet field of the correct polarity and strength The sensor may be part of an integrated circuit package 82 that may include an amplifier and/or switch and/or other components that enable a switching output to take place upon exposure to a magnetic field. Therefore, the sensor 80 is herein broadly defined to include the actual sensor and any other components that enable an electrical switching action when the sensor is exposed to a magnetic field of a polarity and strength to cause said switching action. Electrically connected to the sensor 80/package 82 is a relay 84 and a power source 86. The relay is secured to the board member proximate the sensor, and the power source is preferably a battery that is removably secured to the board member and supplies power to the sensor via the board member's conductive strips 76. Preferably also attached to the board member is a basic on-off switch 88 that can isolate the power source and features an outwardly extending lever portion 90 that can be moved to operate the switch. It should be noted that switch 88 is optional, whereby the circuit can be de-powered by removal of the battery, or be continually in an activated state.

Figure 4:
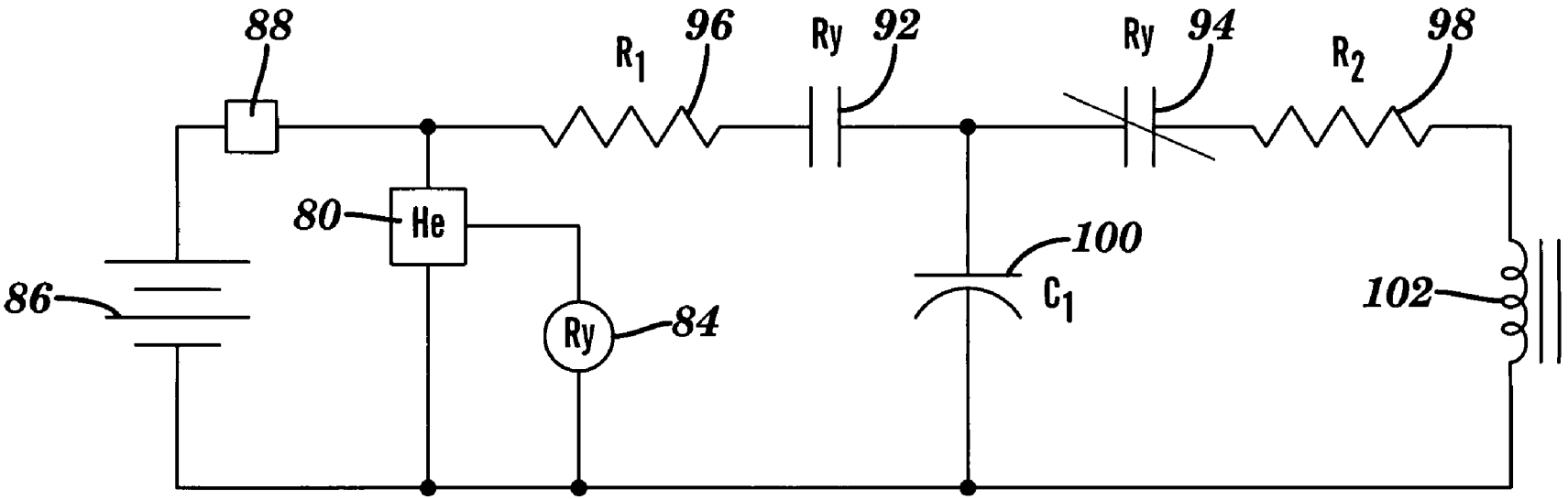
FIG. 4 provides a circuit diagram that shows the interconnections between the electrical components of one of the powered rotation systems employed in the yo-yo shown in FIG. 1.

A general circuit diagram for the components located on the board member is provided in FIG. 4. It should be noted that the circuit diagram additionally shows an open (will not allow the thru-passage of electricity) portion 92 of relay 84, a closed (will allow the passage of electricity) portion 94 of relay 84, first and second resistors 96 and 98 respectively, a capacitor 100 and an electromagnet 102. It should also be noted that the components attached to the board member are shown in a generalized fashion in the figures.

The electromagnet 102 is located proximate end 72 of the board member and is operatively connected to the sensor and the other components on the board member in a manner whereby the electromagnet can become temporarily energized. It should be noted that the power source 86 is also employed to supply power to the electromagnet. It should also be noted that the electromagnet has a significant weight whereby said weight, in combination with the placement of the other components on the board member, causes end 72 of the board member to be biased in a manner whereby it will tend to be located below end 70 of the board member.

A round cap 104 fits over the side portion's cavity 42. The cap is preferably transparent and is preferably secured to the body member via a snap fit of its peripheral edge into a groove 106 located in the cavity's sidewall 44. Other well-known releasable or permanent securement methods for the cap may alternatively be employed.

The cap may include an elongated tab 108 located on a side portion thereof. The tab facilitates a user's being able to remove the cap to gain access to the on-off switch's lever portion 90.

Side portion 4 of yo-yo 1 is preferably identical to side portion 2 and includes an electrically-powered rotation system 56. Since portion 4 has a weight substantially equal to that of side portion 2, the yo-yo 1 will have a balanced weight distribution whereby it will not tend to lean off-center when it is sleeping at the end of its tether.

Figure 7:
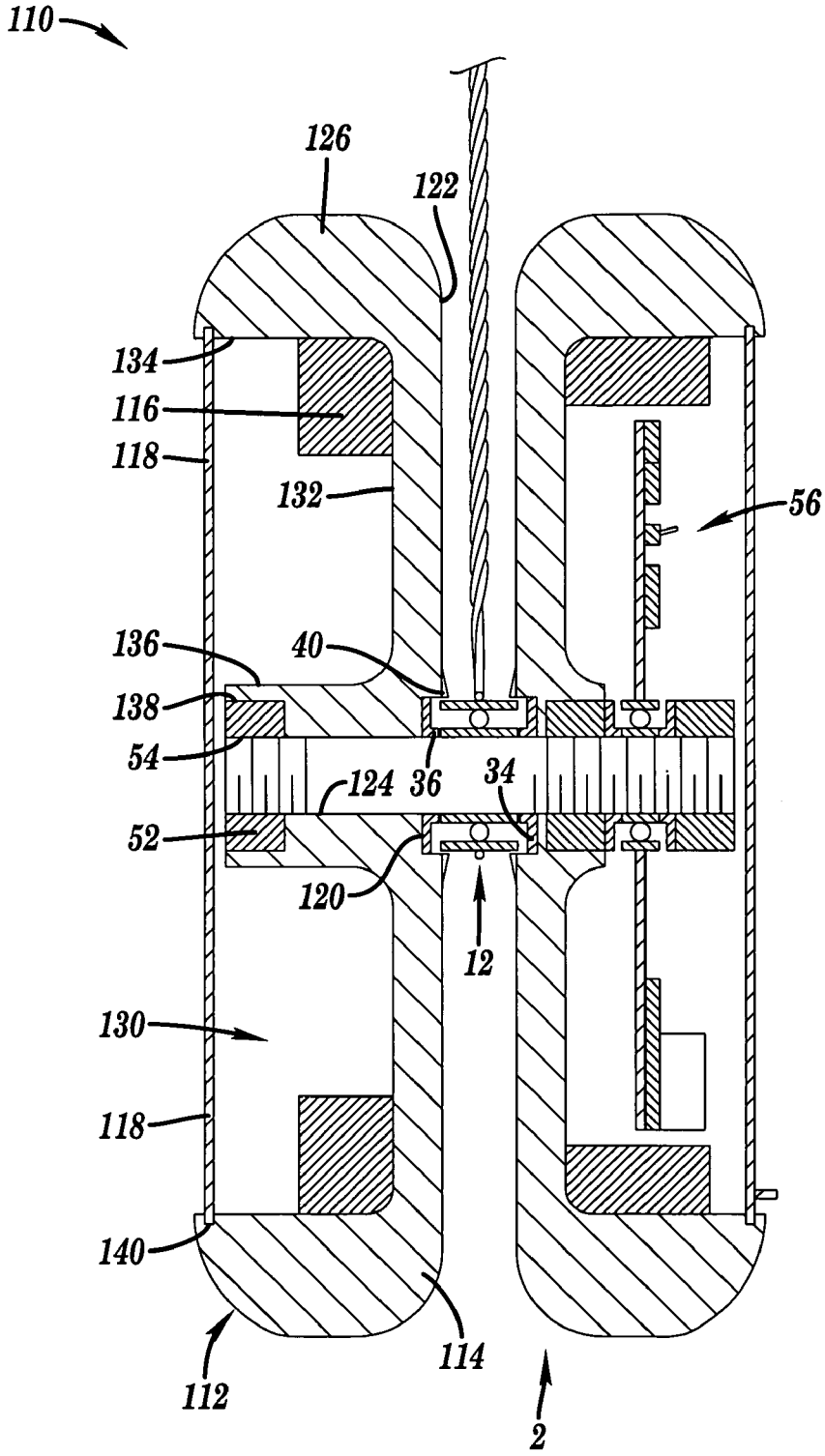
FIG. 7 is a front, cross-sectional view of a second embodiment of a yo-yo in accordance with the invention.

FIG. 7 provides a cross-sectional view of a second embodiment of a yo-yo 110 in accordance with the invention. Yo-yo 110 includes first and second side portions, 2 and 112, respectively. Side portion 2 is structurally and functionally identical to side portion 2 of yo-yo 1 and thereby includes a powered rotation system 56.

Side portion 112 comprises a body member 114, a weight ring 116 and a cap 118. Preferably, the outward appearance of side portion 112 is similar to that of side portion 2.

Body member 114 is in the form of a round disk that includes a cavity 120 located at the center of its tether-facing surface 122. The cavity is sized and shaped to inwardly receive a washer 34 that is located adjacent the yo-yo's center-located ball bearing unit 12. The annular step portion 36 of the washer extends toward, and contacts, the inner race of the ball bearing unit. In this manner, the ball bearing unit's outer race does not contact the washer or body member 114, and is therefore freely rotatable.

The tether-facing surface 122 preferably also features a plurality of optional tether engagement members 40. The tether engagement members are oriented in the same manner as those of side portion 2, similarly extend toward the tether, and have the same functionality.

Body member 114 also includes a center-located thru-bore 124 and a peripherally-located rim portion 126. The rim portion encircles an outwardly-facing cavity 130 that has a bottom/rear surface 132 and a circular sidewall 134. Located at the center of the cavity is an outwardly-extending nipple portion 136 of the body member. Said nipple portion includes, at its distal end, a hexagonally-shaped cavity 138. A nut in the form of hex nut 52 fits into said cavity in a non-rotatable manner. A center-located threaded thru-bore 54 of the hex nut is designed to engage the exterior threads 10 located on one end of the axle pin. In this manner, the hex nut functions to releasably secure side portion 112 to the axle pin.

Weight ring 116 is located in cavity 130 and is fixedly secured to the cavity's sidewall 134, preferably via an interference fit. Alternatively, the weight ring can be secured by other permanent or releasable securement methods, such as by fitting into a complementary groove and/or via fasteners and/or adhesives. The weight ring is preferably made of a metal material and has a weight whereby the weight of side portion 112 will substantially equal that of side portion 2. In this manner, the yo-yo's two side portions will balance each other whereby the yo-yo will not tend to lean toward one side or the other when it is sleeping at the end of the tether.

Cap 118 functions to cover cavity 130 and may be permanently or releasably secured to body member 114. In the embodiment shown, a peripheral edge of the cap is received in an annular groove 140 in the cavity's sidewall 132 and is preferably a snap-fit into said groove.

The operation of the powered rotation system 56 located in side portion 2 of yo-yo 1 will now be described. The yo-yo's other powered rotation system 56, located in side portion 4, as well as the powered rotation system 56 employed in side portion 2 of yo-yo 110, operates in substantially the same manner.

The player would initially activate the rotation system of side portion 2 by removing cap 104 and sliding lever 90 of the system's on-off switch 88 so that the switch is in its "on" position. Next, the user would replace the cap and then release the yo-yo from his or her hand in a manner that will preferably cause the yo-yo to sleep at the end of the tether. As the tether unwinds from about the yo-yo's axle, the yo-yo's side portions will spin at an increasing rate, predominantly due to the action of gravity and to the outwardly-directed force applied to the yo-yo by the user. While the yo-yo's rotation system may also at that time apply a force that tends to cause rotative movement of the yo-yo's side portions, this force would most likely be minimal relative to the other forces acting on the yo-yo. Once the yo-yo is sleeping at the end of the tether, the yo-yo's rotation system 56 will function to maintain the yo-yo's rotational momentum. The rotational velocity that the system will attempt to maintain will be directly related to the size of the capacitor 100 and the resistance value of resistor 96. The system will continue to maintain the yo-yo's rotation as long as it has power.

The operation of the electrically-powered rotation system 56 is based on magnetic attraction and/or repulsion. The system makes use of the electromagnet's weight in combination with the ability of the side portion to rotate relative to the board member 60 to thereby apply force to the magnets 58 that are affixed to the spinning side portion.

When the rotation system is operating and the yo-yo is sleeping at the end of the tether, the board member will become more or less stationary relative to the spinning side portion in which it is housed. This occurs since the weight of the electromagnet 102 is much greater than that of the components located at the other end of the board member, thereby weighing down end 72 of the board member. This causes end 72 of the board member to tend to be located at the lowest point possible, while the ball bearing unit 12 attached to the board member, proximate the board member's midpoint, allows this downward orientation of the board member's end 72 to occur. It should be noted the ball bearing unit's attachment to the yo-yo's axle pin also effectively isolates the board member from the rotation of the rest of the yo-yo.

An understanding of the specific operation of the rotation system can be aided by viewing FIGS. 2 and 4-6. When yo-yo 1 is sleeping at the end of the tether and the body member 24 is spinning in a clockwise direction, FIG. 2 can represent a snapshot of the spinning yo-yo. At the point in time shown in the figure, magnet 58*a* has just moved to a point where it is directly adjacent the sensor 80. Preferably, the gap between the sensor and any adjacent magnet 58 will be relatively small, on the order of 0.06 to 0.5 inches. The allowable size of the gap will depend on such factors as the strength of the magnets 58 and on the sensitivity of the sensor 80. At the position shown, the magnetic flux from magnet 58*a* triggers the sensor whereby the sensor temporarily switches to its "on" condition. The sensor outputs a signal, which may be amplified by an amplifier (not shown), that causes the portions 92 and 94 of relay 84 to assume the conditions shown in FIG. 4. When portion 92 is in the open condition shown in FIG. 4, it does not allow the thru-passage of electricity. When portion 94 is in the closed condition shown in FIG. 4, it allows the thru-passage of electricity. Immediately following relay portion 94 assuming a closed condition, the initially charged capacitor 100 sends a pulse of electricity through resistor 98 and into the electromagnet 102.

Once electromagnet 102 is energized by a pulse of electricity from the capacitor, it generates a magnetic flux. Preferably, the end of the electromagnet proximate end 72 of the board member will be a North pole, while the fixed magnets 58 are oriented whereby each magnet's South pole is located nearer to the yo-yo's axis of rotation than is its North pole. As a result, the actuated electromagnet will apply a pulling force on magnet 58*c* and on magnet 58*d*. However, the clockwise rotation of body member 24 brings magnet 58*c* progressively closer to the electromagnet, as magnet 58*d* moves progressively further way from the electromagnet. As a result, the magnetic force applied to magnet 58*c* by the electromagnet will have much more effect on body member 24 than the magnetic force applied to magnet 58*d* by the electromagnet. The greater attraction force on magnet 58*c* will thereby enhance the body member's clockwise rotation. The attractive force applied by the electromagnet will last until either the circuit shown in FIG. 4 changes, or the capacitor becomes discharged. Preferably, the capacitor is sized to enable the electromagnet to function for sufficient time to counteract the frictional and air resistance forces trying to slow the body member down. In this manner, the action of the electromagnet will prolong the yo-yo's sleep time. Preferably, the weight of the electromagnet is large enough to enable the electromagnet to apply force to any of the magnets 58 without the board member moving to any substantial degree.

Figure 5:
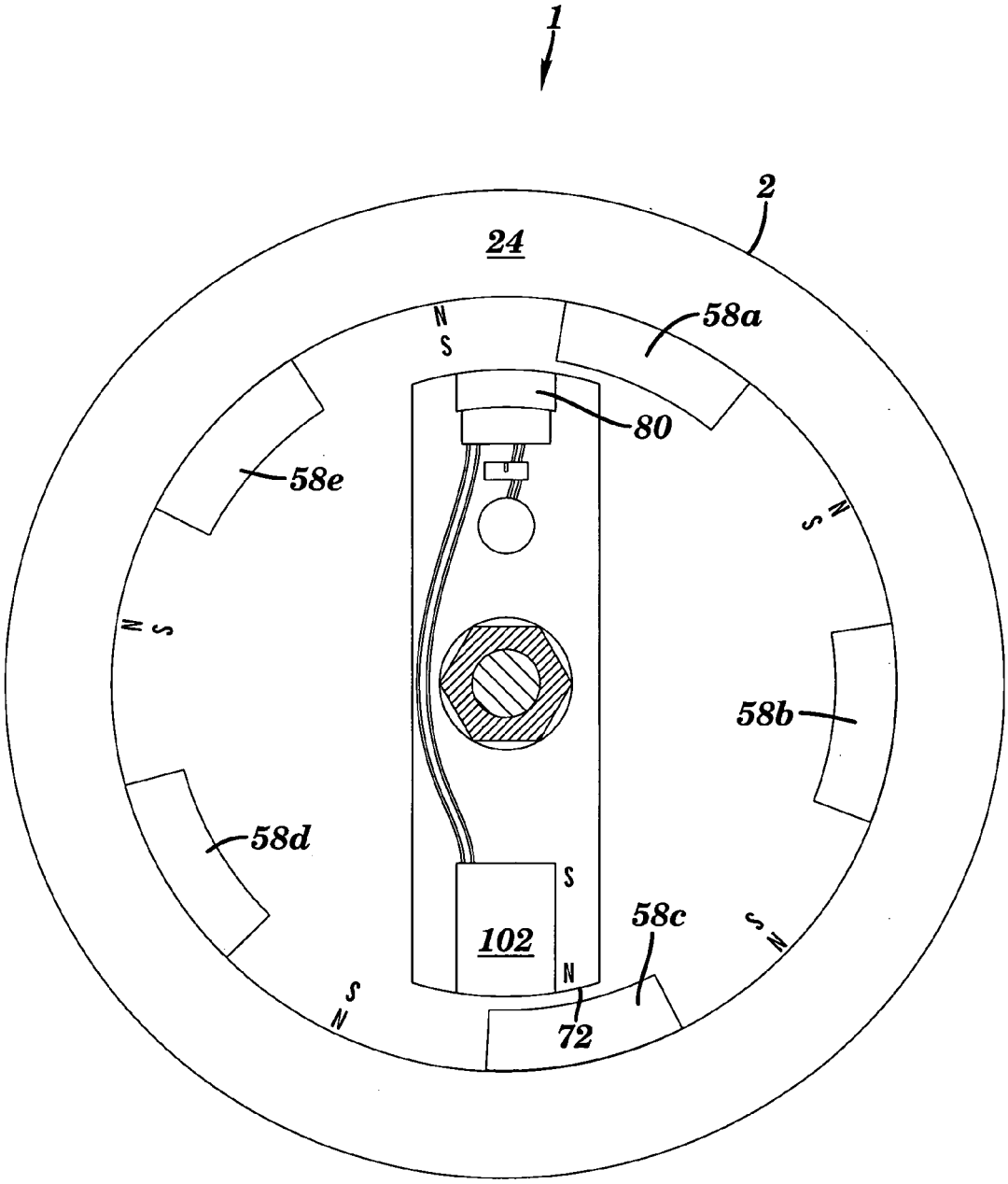
FIG. 5 is a side view of the yo-yo shown in FIG. 1 taken at a point when the side portion's body member is rotated a few degrees clockwise from the position shown in FIG. 2.
Figure 6:
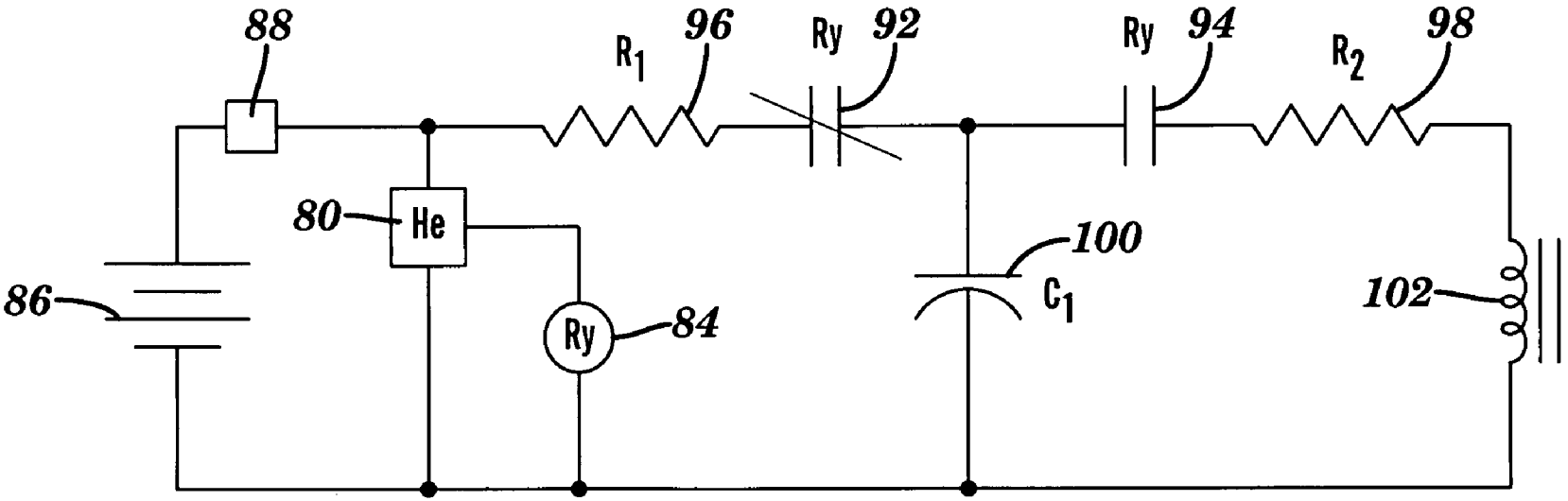
FIG. 6 provides a circuit diagram that shows the interconnections between the electrical components of the powered rotation system when the yo-yo is in the position shown in FIG. 5.

As the yo-yo continues to sleep with the body member 24 moving in a clockwise direction, the body member moves to the position shown in FIG. 5. It should be noted that due to the board member's ball bearing unit, the board member tends to become substantially stationary as the body member moves. Once the magnet 58*a* is no longer opposite the sensor 80, the sensor switches to it's "off" condition. This causes the relay 84 to change its portion 92 to a closed condition that does not allow the thru-passage of electricity, and its portion 94 to an open condition that allows the thru-passage of electricity. This change is reflected in the circuit diagram shown in FIG. 6. It should be noted that once portion 94 opens, the passage of electricity to the electromagnet is stopped. Once the relay's portion 92 closes, electrical power is allowed to flow from the battery, through resistor 96 and into capacitor 100, thereby recharging the capacitor. It should be noted that the charging cycle will continue until another one of the magnets is again opposite the sensor, thereby maximizing the charging time for the capacitor. This enables the capacitor to be charged with a lower drain rate from the battery, which maximizes battery life.

Figure 2:
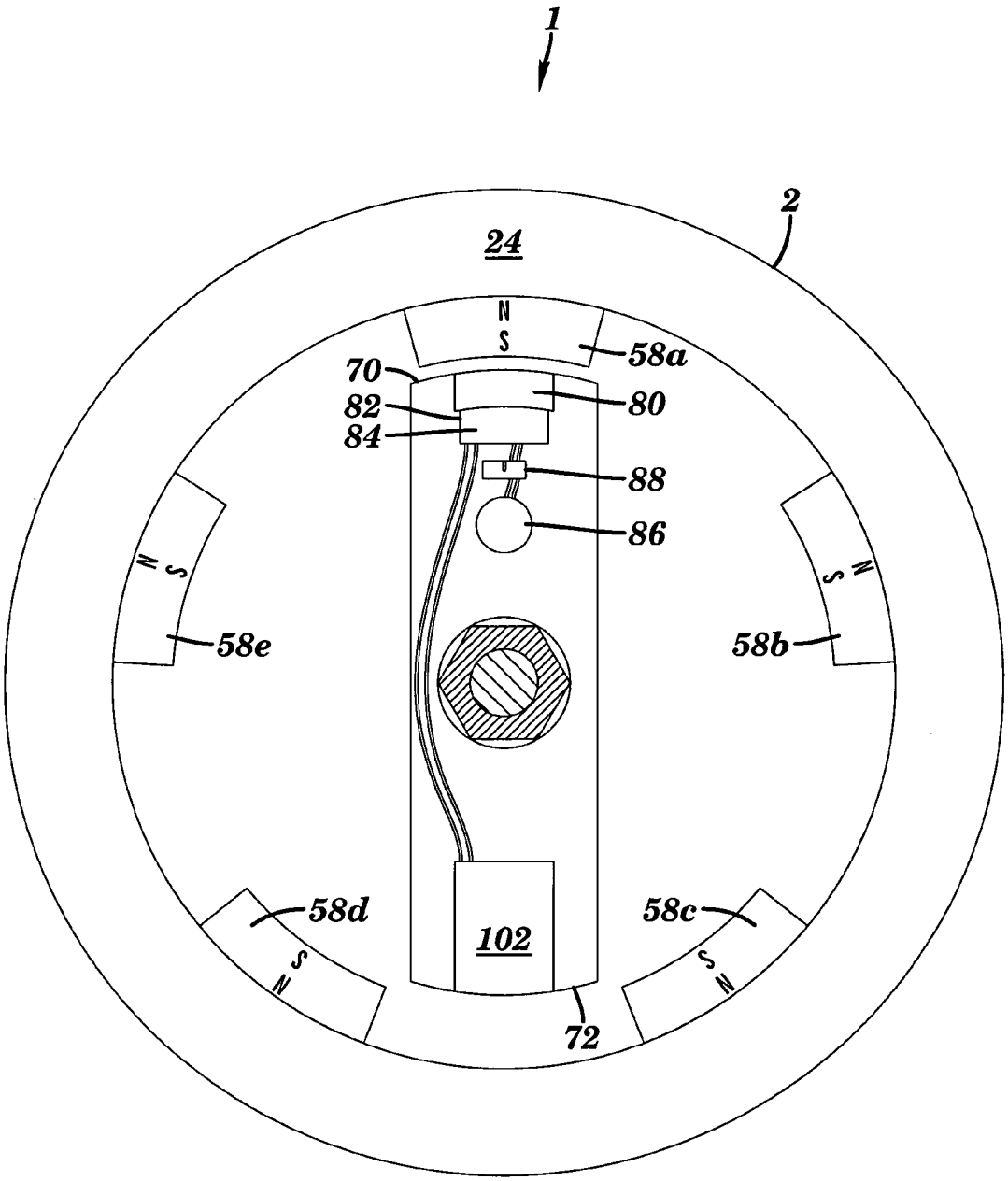
FIG. 2 is a side view of the yo-yo shown in FIG. 1, taken at the plane labeled 2-2 in FIG. 1.
Figure 3:
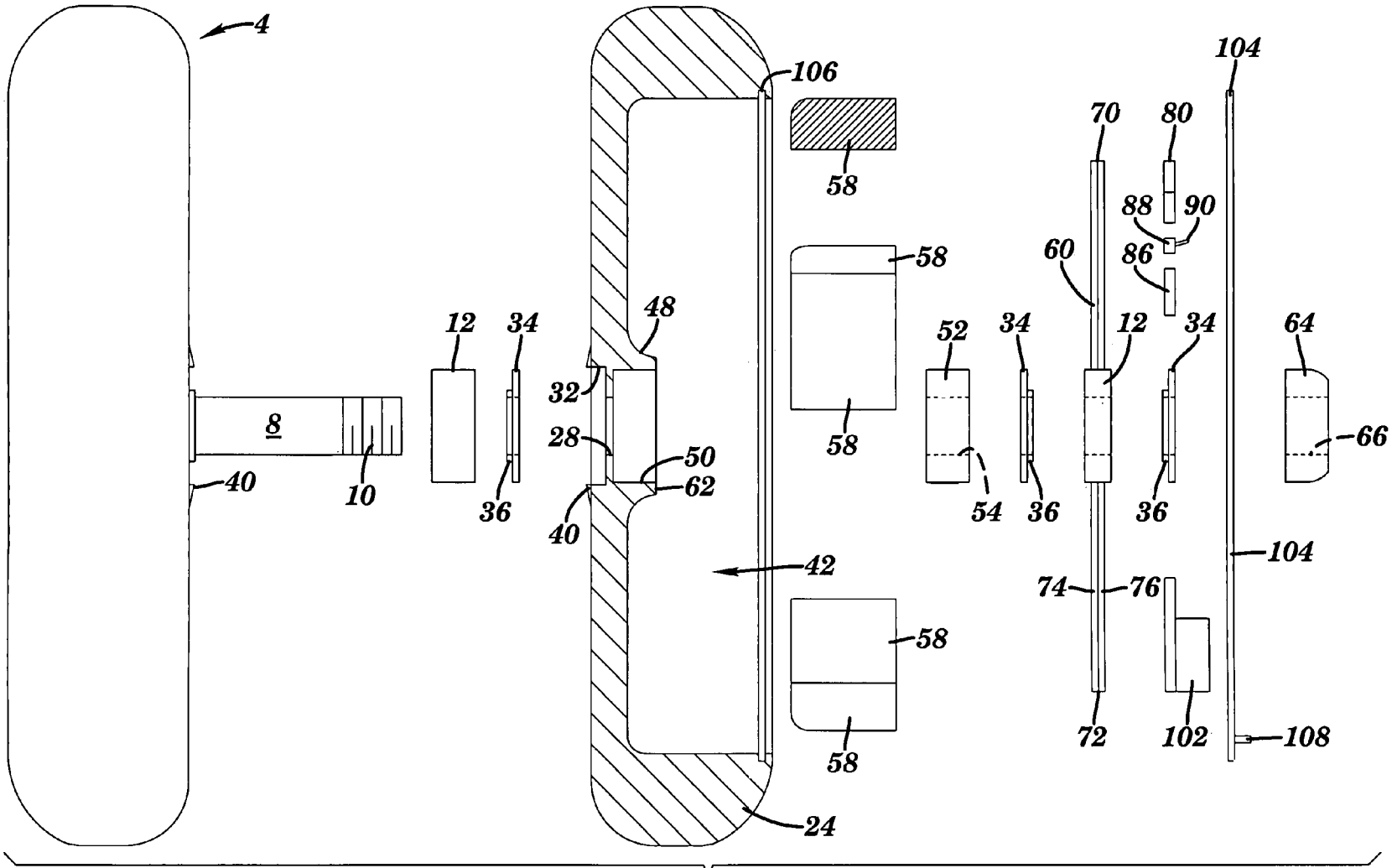
FIG. 3 is a front view of the yo-yo shown in FIG. 1, with the right side of the yo-yo shown in exploded fashion.

The cycle will start again once another of the magnets 58 reaches the same position as magnet 58*a* had in FIG. 2. To continue the example, the cycle would be repeated once magnet 58*e* reaches the same position as is shown for magnet 58*a* in FIG. 2. Once operating in the described manner, the above-described cycle will continue until the battery runs out of power. This enables a user to perform a trick with the yo-yo without having to worry about the yo-yo slowing down to a point where it will no longer return to the user's hand.

If a player wishes to maximize the yo-yo's sleep time, both of the rotation systems of yo-yo 1 would be initially activated. If the player instead wishes to maximize battery life, only one of the rotation systems of yo-yo 1 would be activated prior to the yo-yo's use. In addition, if each rotation system of yo-yo 1 has a fully charged battery, a player may only need to activate one rotation system to produce an extended sleep time sufficient to complete the desired trick(s).

While the rotation system shown being employed in yo-yo 110 is the same as that shown for yo-yo 1, it should be noted that one may want to employ a more robust/powerful system if the yo-yo is to have only a single rotation system. In addition, the circuit shown in FIG. 4 may be modified to produce multiple pulses of the electromagnet with each triggering of the sensor. This would be accomplished by employing a double-pole, double-throw relay in place of the single-pole, double-throw relay shown. As another alternative, a simpler circuit can be employed in which the capacitor 100 is not employed and the electromagnet 102 is directly caused to be energized by an output from the sensor 80, or by an output from an integrated circuit that includes the sensor, or by the relay 84. Other variations to the circuit shown in FIG. 4 may be alternatively employed to achieve substantially the same results.

It should be noted that the board member 60 can be fashioned from other types of rigid or semi-rigid boards/members in lieu of the circuit board shown in the figures. For example, the circuit board can be replaced by a rigid plastic, or metal, plate onto which the previously described electrical components are mounted. For such a substitution, said electrical components would be connected together using wires.

The yo-yo side portions 2, 4 and 112 can have other forms, or shapes, than those shown. Furthermore, the axle structure may be formed of other components than the ones shown in the figures.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

We claim:

1. A yo-yo comprising:

first and second side portions secured together in a spaced-apart relation by an axle structure;

a tether operatively connected to said axle structure;

wherein said first side portion comprises a body member, a plurality of permanent magnets fixedly secured to said body member, and a board member, wherein said permanent magnets are spaced apart from each other;

wherein said board member is rotatably secured to said yo-yo in a manner whereby said board member is freely rotatable relative to said body member, wherein a sensor capable of detecting a magnetic field is secured to a first portion of said board member, wherein an electromagnet is secured to a second portion of said board member, and wherein an electrical power source is operatively connected to said sensor and to said electromagnet in a manner whereby it can provide electrical power to said sensor and to said electromagnet; and wherein when said first side portion is spinning and there is relative movement between said body member and said board member, whenever a first one of said permanent magnets passes by said sensor, said sensor will cause said electromagnet to become temporarily energized whereby said electromagnet will apply a force to another of said permanent magnets in a manner whereby said force tries to at least maintain a rotational momentum of said first side portion.

2. The yo-yo of claim 1 wherein said permanent magnets are located in a rim portion of the body member and wherein said first and second portions of said board member are both located proximate a periphery of said board member whereby they are located adjacent said rim portion.

3. The yo-yo of claim 1 wherein said permanent magnets are evenly distributed about said body member.

4. The yo-yo of claim 1 wherein each of said permanent magnets has a first pole and a second pole and wherein said first poles of all of said permanent magnets are of the same polarity and are oriented closer to said axle structure than each of said magnets second pole.

5. The yo-yo of claim 1 wherein said power source is in the form of a battery that is releasably secured to said board member.

6. The yo-yo of claim 1 wherein said board member has an elongated shape, wherein said first and second portions of said board member are located at opposite ends of said board member and wherein said board member is weighted in a manner wherein it can be positioned so that gravity will bias one of said portions of said board member to be located below the other of said portions of said board member.

7. The yo-yo of claim 1 wherein a switch is secured to said board member, is electrically connected to said power source and can function to isolate said power source.

8. The yo-yo of claim 1 wherein the board member includes an attached ball bearing unit that is connected to a portion of said axle structure.

9. The yo-yo of claim 8 wherein said axle structure includes an axle pin that extends through said body member and has a portion that extends through a center-located opening in said ball bearing unit.

10. The yo-yo of claim 1 wherein a capacitor is secured to said board member, can be charged by said power source and can send a pulse of electricity to said electromagnet.

11. The yo-yo of claim 1 wherein the board member is unevenly weighted whereby said board member can be positioned in a manner whereby gravity will bias said board member to be in a position in which one of said portions of said board member is located below another of said portions of said board member.

12. The yo-yo of claim 1 wherein a relay is secured to said board member and is operatively connected to said sensor and to said electromagnet.

13. The yo-yo of claim 1 wherein a capacitor and a resistor are secured to said board member and are electrically connected to the power source and to the electromagnet and wherein the rotation system will attempt to maintain a rotational velocity of the yo-yo that is directly related to the value of said capacitor times the value of said resistor.

14. The yo-yo of claim 1 wherein the board member is in the form of a circuit board.

15. The yo-yo of claim 1 wherein said sensor has a tip portion that can be located proximate one of said permanent magnets.

16. The yo-yo of claim 1 wherein said second side portion is substantially identical to said first side portion.

17. The yo-yo of claim 1 wherein said second side portion includes a weight ring and has a total weight that is substantially identical to a total weight of the first side portion.

18. The yo-yo of claim 1 wherein the sensor is a Hall-effect sensor.

19. The yo-yo of claim 1 wherein the sensor is a Reed relay.

20. A yo-yo comprising:

first and second side portions secured together in a spaced-apart relation by an axle structure;

a tether operatively connected to said axle structure;

wherein said first side portion comprises first and second members, wherein one of said members is freely rotatable relative to the other of said members, wherein a rim portion of said first side portion forms a peripheral portion of one of said members, wherein said first member includes a permanent magnet, wherein said second member includes a sensor and an electromagnet, wherein said sensor is capable of detecting a magnetic field, and wherein an electrical power source is operatively connected to said sensor and to said electromagnet in a manner whereby it can provide electrical power to said sensor and to said electromagnet; and wherein when said first side portion is spinning in a manner whereby there is relative movement between its first and second members, whenever said permanent magnet passes by said sensor in a predetermined manner, said sensor will cause said electromagnet to become temporarily energized whereby it generates a magnetic field that applies a force to the member having said rim portion whereby said force is directed in a manner whereby said force tries to at least maintain a rotational momentum of said rim portion.

21. The yo-yo of claim 20 wherein the first and second members of the first side portion are both secured to said axle structure and wherein said first member is fixedly secured to said axle structure and said second member is secured to said axle structure by a rotatable unit.

22. A yo-yo comprising:

first and second side portions secured together in a spaced-apart relation by an axle structure;

a tether connected to said axle structure;

wherein said first side portion comprises a body member, a board member, and first and second magnets, wherein said magnets are fixedly secured to said body member in a spaced-apart relation;

wherein said body member is fixedly secured to said axle structure, and wherein said board member is rotatably secured to said axle structure in a manner whereby said body member can move relative to said board member;

a sensor capable of detecting a magnetic field fixedly secured to said board member and located proximate a peripheral edge of said board member;

a third magnet in the form of an electromagnet, wherein said third magnet is fixedly secured to said board member, is located proximate a peripheral edge of said board member, and is spaced from said sensor;

a power source operatively connected to said yo-yo whereby it can supply power to said sensor and to said third magnet; and wherein when said body member is rotating relative to said board member and said first magnet passes said sensor, said sensor can cause a temporary actuation of said third magnet whereby said third magnet applies a force to said second magnet that is directed in a manner whereby said force tries to positively affect the rotation of said body member.

23. The yo-yo of claim 22 wherein when said yo-yo is sleeping whereby both of said first and second side portions are spinning in either a clockwise or counterclockwise direction, said third magnet will be intermittently applying a force to said second magnet in a direction that helps to maintain the rotation of the side portions.

* * * * *